US009194406B2

(12) United States Patent
Machijima et al.

(10) Patent No.: US 9,194,406 B2
(45) Date of Patent: Nov. 24, 2015

(54) POSITION DETECTING DEVICE FOR FLUID PRESSURE CYLINDER

(75) Inventors: Mitsuru Machijima, Matsudo (JP); Kunihiro Suzuki, Tsukubamirai (JP)

(73) Assignee: SMC CORPORATION, Tokyo (JP)

( * ) Notice: Subject to any disclaimer, the term of this patent is extended or adjusted under 35 U.S.C. 154(b) by 359 days.

(21) Appl. No.: 13/993,559

(22) PCT Filed: Nov. 25, 2011

(86) PCT No.: PCT/JP2011/077166

§ 371 (c)(1),
(2), (4) Date: Jun. 12, 2013

(87) PCT Pub. No.: WO2012/086361

PCT Pub. Date: Jun. 28, 2012

(65) Prior Publication Data

US 2013/0263733 A1 Oct. 10, 2013

(30) Foreign Application Priority Data

Dec. 21, 2010 (JP) ..... 2010-284606

(51) Int. Cl.
*F15B 15/28* (2006.01)

(52) U.S. Cl.
CPC ..... *F15B 15/2815* (2013.01); *F15B 15/28* (2013.01); *F15B 15/2892* (2013.01)

(58) Field of Classification Search
CPC .... F15B 15/2807; F15B 15/2892; H05R 7/04
See application file for complete search history.

(56) References Cited

U.S. PATENT DOCUMENTS

D453,677 S 2/2002 Machijima et al.
D457,805 S 5/2002 Machijima et al.
7,372,708 B2 5/2008 Terasaki et al.

FOREIGN PATENT DOCUMENTS

JP 2004 125150 4/2004

OTHER PUBLICATIONS

International Search Report Issued Jan. 10, 2012 in PCT/JP11/77166 Filed Nov. 25, 2011.

*Primary Examiner* — F. Daniel Lopez
(74) *Attorney, Agent, or Firm* — Oblon, McClelland, Maier & Neustadt, L.L.P.

(57) ABSTRACT

A sensor holding member holding a position sensor and an attachment member that attaches the sensor holding member to a cylinder tube are formed separately. The sensor holding member is placed with a sensor attachment groove oriented in the direction of the axis of the cylinder tube and in contact with the outer surface of the cylinder tube. The attachment member is placed so as to straddle the sensor holding member. By tightening an attachment screw and fixing the attachment member with an attachment band, the sensor holding member is pressed against and fixed to the outer surface of the cylinder tube by the attachment member. Loosening the attachment screw allows the sensor holding member to be displaced relative to the attachment member in the direction of the axis of the cylinder tube.

16 Claims, 6 Drawing Sheets

POSITION DETECTING DEVICE FOR FLUID PRESSURE CYLINDER

TECHNICAL FIELD

The present invention relates to a position detecting device that detects the operating position of a piston of a fluid pressure cylinder, and more specifically, it relates to such a type of position detecting device that a position sensor is attached to a cylinder tube using an attachment band.

BACKGROUND ART

In general, a position detecting device is attached to a fluid pressure cylinder in order to detect the operating position of a piston and to use the detection signal as a signal for controlling the fluid pressure cylinder. This position detecting device detects the magnetism of a permanent magnet attached to the piston with a magnetically sensitive position sensor attached to the outer surface of the cylinder tube. In order to attach the position sensor to the outer surface of the cylinder tube, various mechanisms have been used.

For example, in Patent Document 1, there is disclosed such a position detecting device that a sensor holder having a sensor insertion groove having a narrow opening is attached to the outer surface of a cylinder tube with an attachment band (belt-like band), a position sensor is placed into the sensor insertion groove, and the position sensor is fixed to the sensor holder with a locking screw screwed into the position sensor. In this position detecting device, the position adjustment of the position sensor is performed by loosening the locking screw, moving the position sensor to the optimum detecting position in the sensor holder, and tightening the locking screw again at that position.

However, a method in which only a position sensor is moved to adjust the position as in this position detecting device lacks the flexibility in position adjustment. For example, when the attachment position of the attachment band relative to the cylinder tube is restricted, it is not enough to move the position sensor.

Position adjustment can also be performed by moving the sensor holder. However, in this case, it is necessary to connect the sensor holder and the attachment band with an attachment screw and an elongate hole, and the sensor holder is easily displaced in the direction of the elongate hole by vibration or the like.

CITATION LIST

Patent Literature

Patent Document 1: Japanese Unexamined Patent Application Publication No. 2004-125150

SUMMARY OF INVENTION

Technical Problem

It is an object of the present invention to provide a position detecting device for a fluid pressure cylinder in which a position sensor can be position-adjustably attached to a cylinder tube with an attachment band and a sensor holder, the degree of freedom in position adjustment is high, and the position sensor is not displaced by vibration.

Solution to Problem

To attain the above object, a position detecting device of the present invention includes a position sensor that detects the position of a piston of a fluid pressure cylinder, a sensor holder that position-adjustably holds the position sensor, and an attachment band that attaches the sensor holder to the outer periphery of a cylinder tube.

The attachment band has a band main body surrounding the outer periphery of the cylinder tube, and a pair of clamping portions formed at both ends of the band main body so as to face each other, the sensor holder is clamped between the pair of clamping portions, and the sensor holder is fixed between the clamping portions by moving the pair of clamping portions toward each other with an attachment screw.

The sensor holder includes a sensor holding member having a sensor attachment groove in which the position sensor fits, and an attachment member clamped between the pair of clamping portions of the attachment band, and the sensor holding member and the attachment member are formed separately. The sensor holding member is placed, with the sensor attachment groove oriented in the direction of the axis of the cylinder tube, so as to be in contact with the outer surface of the cylinder tube, the attachment member is placed, with the sensor holding member fitted in a fitting groove in the lower surface of the attachment member, so as to straddle the sensor holding member, the attachment member and the sensor holding member are fixed to each other by tightening the attachment screw and fixing the attachment member between the clamping portions, and loosening the attachment screw allows the sensor holding member to be displaced relative to the attachment member in the direction of the axis of the cylinder tube.

According to a specific embodiment of the present invention, the position sensor has an indicator lamp that lights during operation, and a sensor fixing screw that fixes the position sensor in the sensor attachment groove, the attachment member has, at one end and the other end in a direction along the sensor attachment groove, a hollow portion and a see-through window each having such a depth that they extend from the upper surface of the attachment member to the fitting groove, the hollow portion is used for rotationally operating the sensor fixing screw with a tool, and the see-through window is used for viewing the indicator lamp.

In this case, it is preferable that the hollow portion and the see-through window be recesses formed so as to extend from one end and the other end of the attachment member toward the center of the attachment member and so as to face each other.

According to another specific embodiment of the present invention, on each of the left and right side surfaces of the attachment member, two ribs extending in the height direction of the attachment member are formed parallel to each other, and by placing the clamping portion of the attachment band between the two ribs, relative rotation between the clamping portion and the sensor holder about the attachment screw is prevented.

In the present invention, it is preferable that when the sensor holder is fixed to the outer periphery of the cylinder tube with the attachment band, the upper wall of the fitting groove be in contact with the upper surface of the sensor holding member, and the lower ends of both side walls of the fitting groove be out of contact with the outer surface of the cylinder tube.

In the present invention, it is preferable that one end of the sensor attachment groove be open, an insertion hole be formed at the one end, and the other end be closed by a wall.

In the present invention, a plurality of engaging recesses may be formed along the sensor attachment groove in rows, engaging protrusions engaging with the engaging recesses may be formed in the attachment member, the engaging protrusions may be engaged with the engaging recesses when the attachment screw is tightened, and the engaging protrusions may be disengaged from the engaging recesses when the attachment screw is loosened.

In this case, it is preferable that the engaging recesses are formed on both left and right sides of the sensor attachment groove, and the engaging protrusions be formed on each of the left and right groove walls of the fitting groove in the attachment member.

In the present invention, stoppers that engage with the ends of the attachment member and prevent the sensor holding member from disengaging from the attachment member may be formed at one end and the other end of the sensor holding member in a direction along the sensor attachment groove.

In the present invention, a sensor fixing screw that fixes the position sensor in the sensor attachment groove may have a flange-like engaging portion on its head, the engaging portion may be able to be selectively engaged with an edge outer surface of an opening of the sensor attachment groove and the upper wall surface of a through-hole of the attachment member by rotating the sensor fixing screw clockwise and counterclockwise, the position sensor may be engaged with and fixed to an edge inner surface of the opening of the sensor attachment groove when the engaging portion is engaged with the edge outer surface, and the position sensor may be pressed against and fixed to the groove bottom of the sensor attachment groove when the engaging portion is engaged with the upper wall surface of the through-hole.

Advantageous Effects of Invention

According to the present invention, by loosening the attachment screw, the sensor holding member can be displaced with respect to the attachment member, with the attachment member held between the pair of clamping portions of the attachment band, to perform the position adjustment of the position sensor. In addition, the position sensor can be position-adjusted separately with respect to the sensor holding member. Therefore, the degree of freedom in position adjustment is high.

In addition, since it is not necessary to connect the attachment band and the sensor holder with an elongate hole or the like, the problem in that the position sensor is easily displaced along the elongate hole by vibration can be avoided.

DESCRIPTION OF EMBODIMENTS

Figure 1:
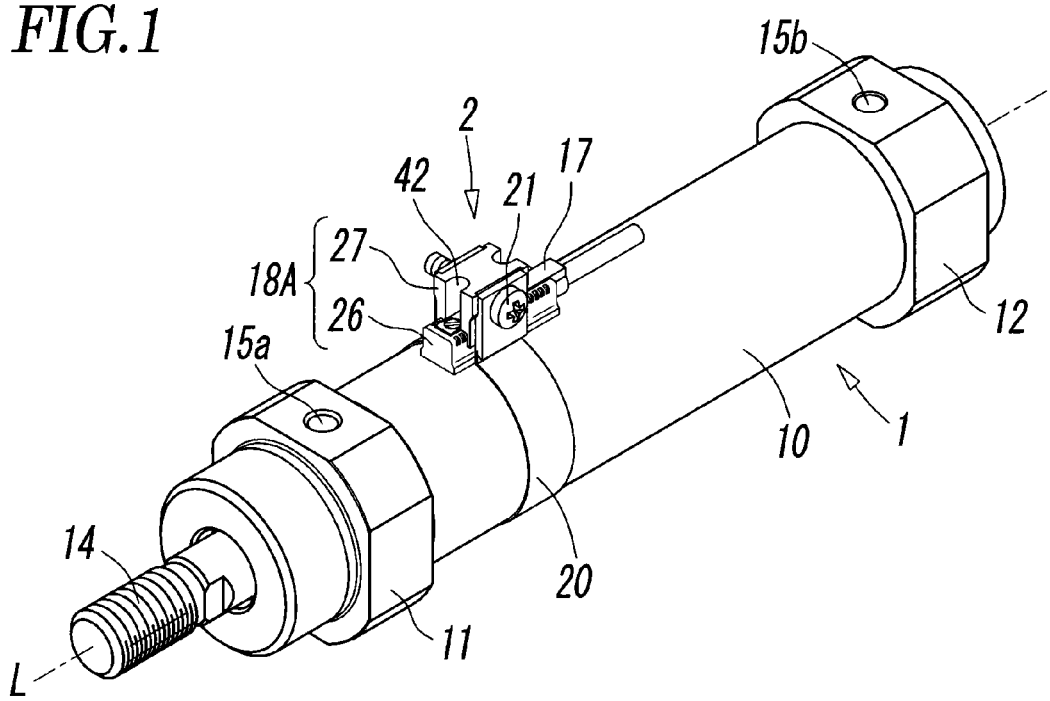
FIG. 1 is a perspective view of an assembled state showing a first embodiment of a position detecting device according to the present invention.
Figure 2:
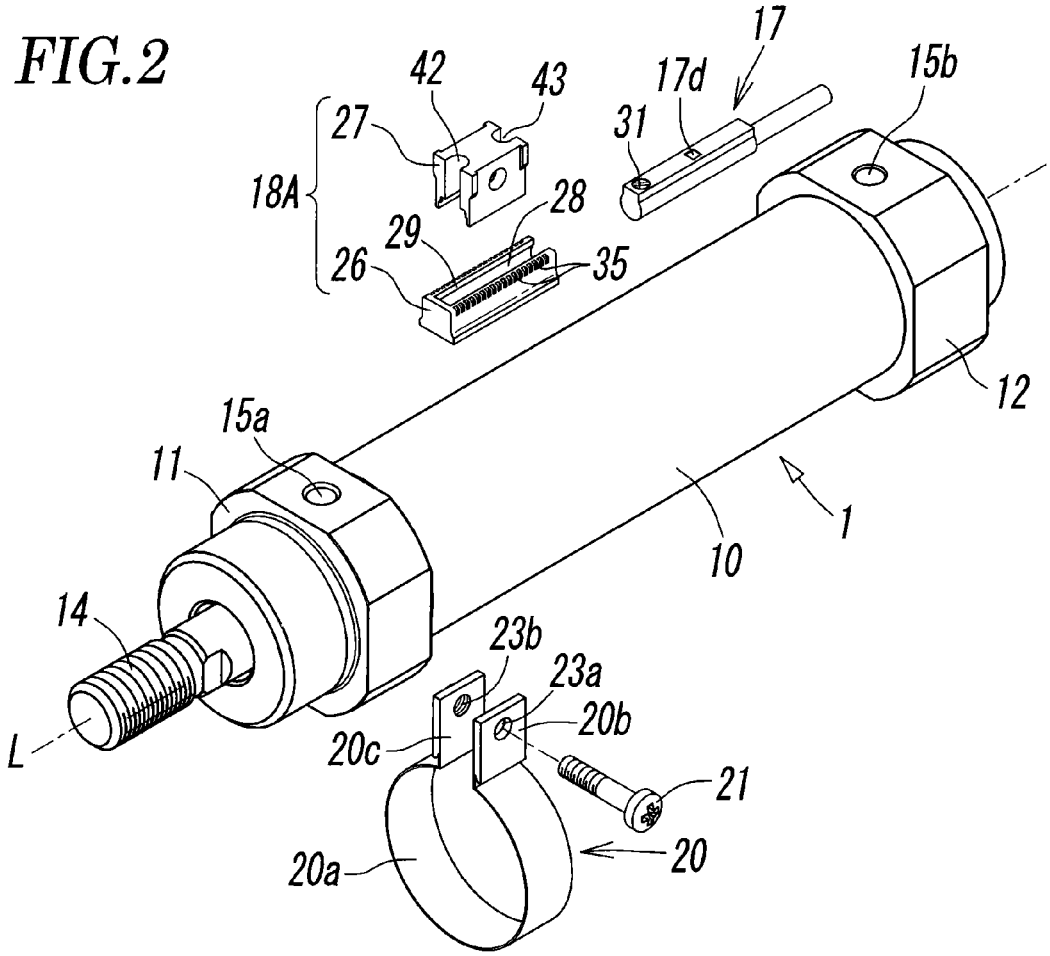
FIG. 2 is an exploded perspective view showing the position detecting device of FIG. 1.
Figure 3:
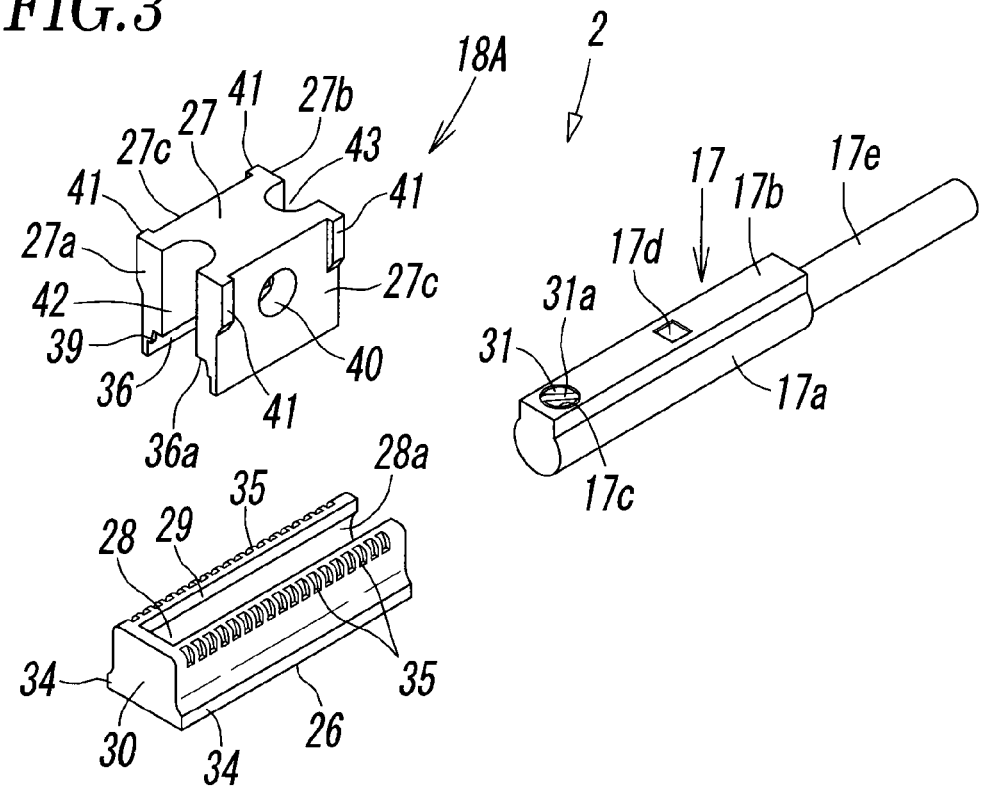
FIG. 3 is a partial enlarged view of FIG. 2.
Figure 4:
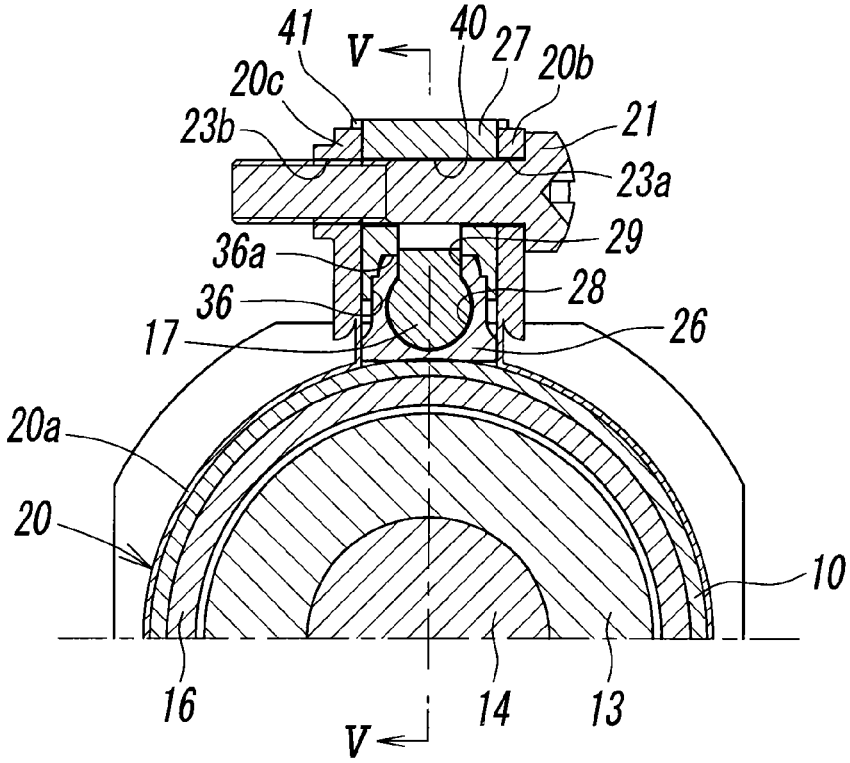
FIG. 4 is a partial enlarged sectional view of FIG. 1.
Figure 5:
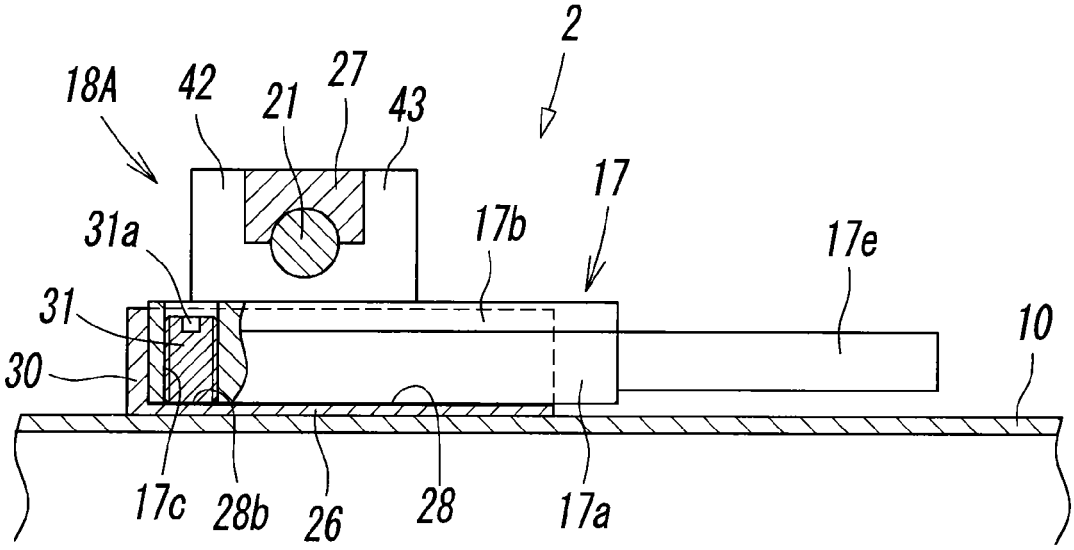
FIG. 5 is a sectional view taken along line V-V of FIG. 4.
Figure 6:
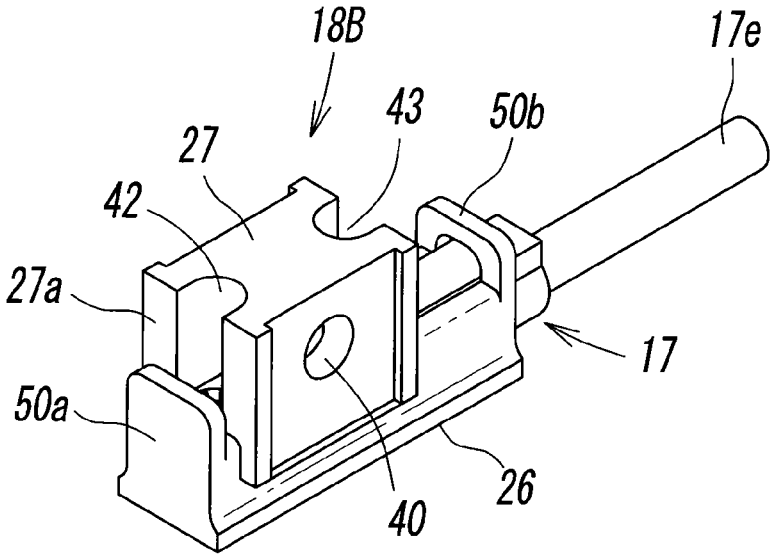
FIG. 6 is a perspective view of an assembled state showing a second embodiment of a position detecting device according to the present invention.
Figure 7:
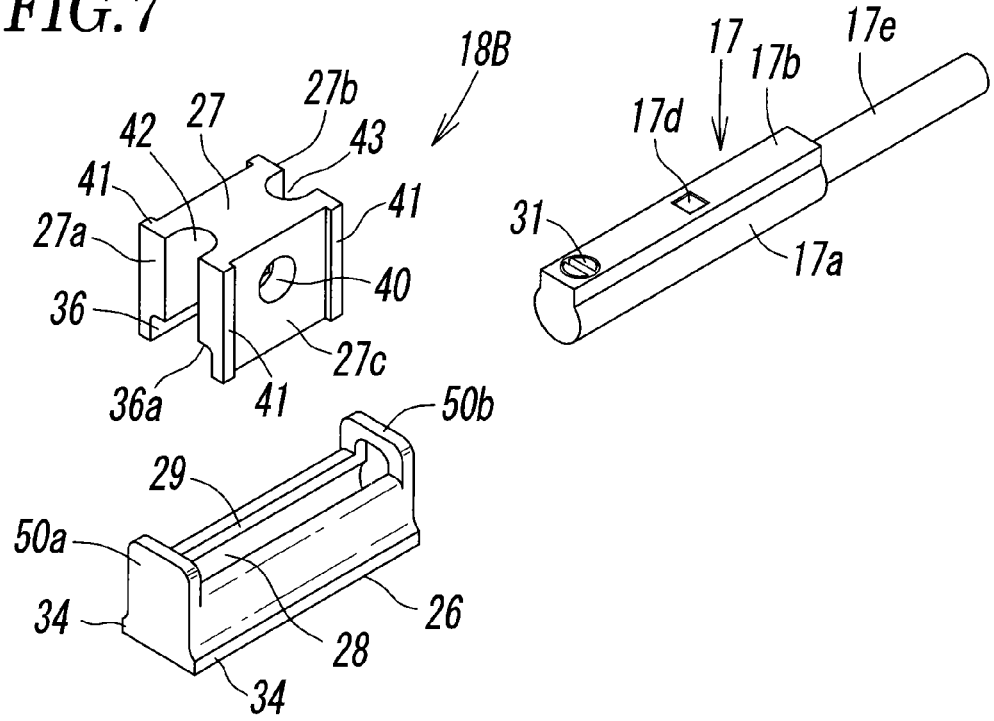
FIG. 7 is an exploded perspective view showing the sensor holder of FIG. 6.
Figure 8:
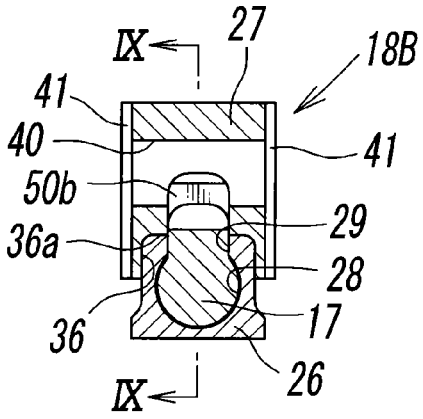
FIG. 8 is a cross-sectional view of FIG. 6.
Figure 9:
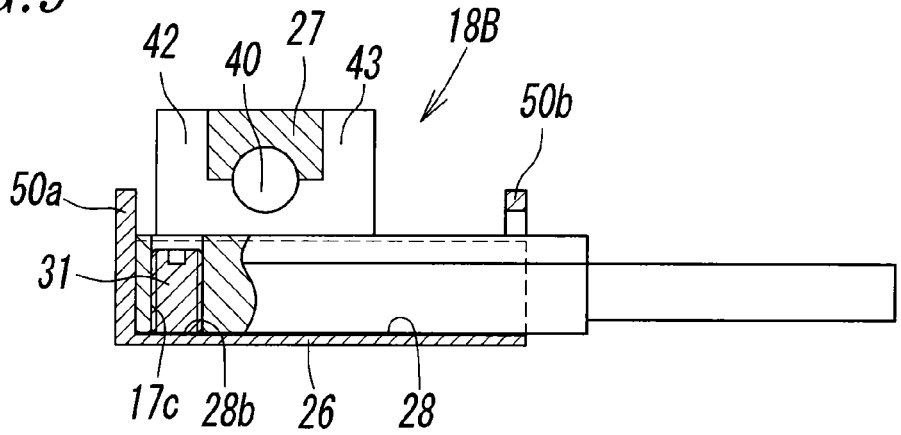
FIG. 9 is a sectional view taken along line IX-IX of FIG. 8.
Figure 10:
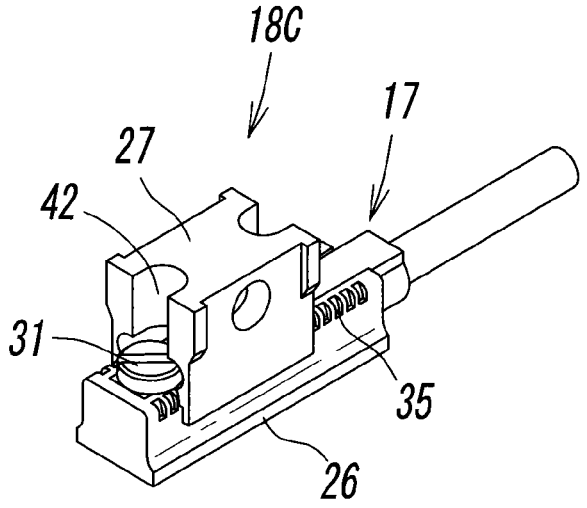
FIG. 10 is a perspective view of an assembled state showing a third embodiment of a position detecting device according to the present invention.
Figure 11:
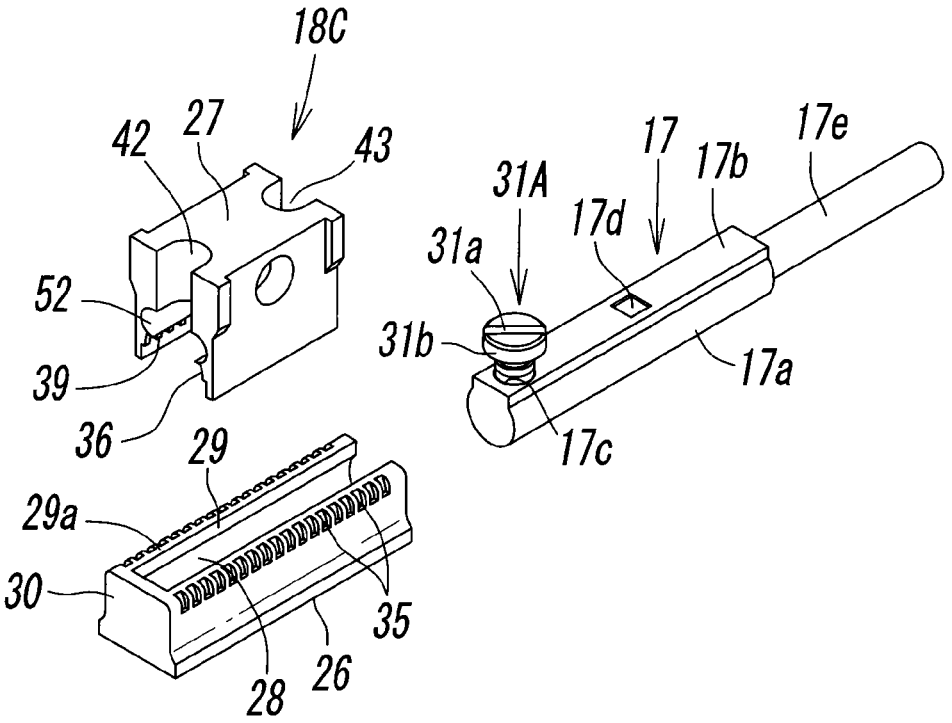
FIG. 11 is an exploded perspective view showing the sensor holder of FIG. 10.

FIG. 1 to FIG. 5 show a first embodiment of a position detecting device according to the present invention. Reference sign 1 in the figures denotes a fluid pressure cylinder, and reference sign 2 denotes a position detecting device attached to the outer surface of the fluid pressure cylinder 1.

The fluid pressure cylinder 1 has a cylinder tube 10 having a cylinder hole therein and having a cylindrical shape, and a rod cover 11 and a head cover 12 attached to both ends of the cylinder tube 10. A piston 13 is contained within the cylinder tube 10 slidably in the direction of the central axis L of the cylinder tube 10 (hereinafter referred to as "tube axis"). A piston rod 14 whose proximal end is connected to the piston 13 slidably passes through the rod cover 11 and extends toward a position in front of the cylinder tube 10.

Ports 15*a* and 15*b* are formed in the rod cover 11 and the head cover 12. By alternately supplying and discharging pressure fluid (for example, compressed air) to and from pressure chambers on both sides of the piston 13 through the ports 15*a* and 15*b*, the piston 13 and the piston rod 14 is moved back and forth.

A ring-shaped permanent magnet 16 is attached to the outer periphery of the piston 13. By detecting the magnetism of the permanent magnet 16 with the position detecting device 2, the operating position of the piston 13 is detected. In this case, when the position detecting device 2 is attached to a part of the cylinder tube 10 near the rod cover 11 as shown, the position of the forward stroke end of the piston 13 can be detected. When the position detecting device 2 is attached to a part of the cylinder tube 10 near the head cover 12, the position of the backward stroke end of the piston 13 can be detected. When two position detecting devices 2 are attached to parts of the cylinder tube 10 near both ends thereof, the positions of the forward stroke end and the backward stroke end of the piston 13 can be detected.

The position detecting device 2 includes a position sensor 17 that detects the magnetism of the permanent magnet 16, a sensor holder 18A that holds the position sensor 17, an attachment band 20 that attaches the sensor holder 18A to the outer periphery of the cylinder tube 10, and an attachment screw 21 that performs the fixation of the attachment band 20 to the cylinder tube 10 and the fixation of the sensor holder 18A to the attachment band 20 at the same time.

The attachment band 20 is formed by arcuately curving a strip-shaped elastic metal plate, preferably a non-magnetic metal plate, and has a band main body 20*a* surrounding the outer periphery of the cylinder tube 10 and a pair of clamping portions 20*b* and 20*c* formed at both ends of the band main body 20*a* so as to face each other. If necessary, belt-like or point-like antislip protrusions made of rubber, synthetic resin, or the like can be attached to the inner surface of the band main body 20*a*.

The inner surfaces of the pair of clamping portions 20*b* and 20*c* are flat clamping surfaces. Screw tightening holes 23*a* and 23*b* are formed in the pair of clamping portions 20*b* and 20*c*, respectively. The first screw tightening hole 23*a* formed in one of the clamping portions 20*b* is a normal hole on the inner surface of which an internal thread is not formed, and the second screw tightening hole 23*b* formed in the other clamping portion 20*c* is a threaded hole on the inner surface of which an internal thread is cut. An external thread at the distal end of the attachment screw 21 inserted through the first screw tightening hole 23*a* is engaged with the internal thread on the inner surface of the second screw tightening hole 23*b*.

Of the pair of clamping portions 20*b* and 20*c*, at least the clamping portion 20*c* in which the second screw tightening hole 23*b* is formed is formed so as to be thicker than the band main body 20*a* by integrally joining or superimposing a reinforcing member to or on the end of the attachment band 20, and can also be formed by folding the end of the attachment band 20.

The attachment band 20 can also be formed of a hard and elastic synthetic resin.

The sensor holder 18A includes a sensor holding member 26 having a sensor attachment groove 28 in which the position sensor 17 fits, and an attachment member 27 clamped between the clamping portions 20*b* and 20*c* of the attachment band 20. The attachment member 27 and the sensor holding member 26 are separately formed of a non-magnetic material such as synthetic resin.

The sensor holding member 26 is a rod-shaped member that is more laterally elongate than the attachment member 27, includes the sensor attachment groove 28 extending in the longitudinal direction thereof, and an opening 29 extending along the upper part of the sensor attachment groove 28, and is placed with the sensor attachment groove 28 oriented in the direction of the axis L of the cylinder tube 10 and with the bottom surface in contact with the outer surface of the cylinder tube 10.

The sensor attachment groove 28 has a major-arc-shaped cross-section, and therefore the width of the opening 29 is narrower than the groove width of the inside. One end (rear end) in the longitudinal direction of the sensor attachment groove 28 is open as a sensor insertion opening 28*a*, and the other end (front end) is closed by a wall 30. The position sensor 17 is inserted through the sensor insertion opening 28*a* into the sensor attachment groove 28, and is fixed in the sensor attachment groove 28 with a sensor fixing screw 31.

The position sensor 17 has an elongate rod shape and includes a main body portion 17*a* having a major-arc-shaped cross-section, and a platform-like portion 17*b* formed on the top of the main body portion 17*a* and having a rectangular cross-section. The diameter (width) of the main body portion 17*a* is less than the width of the inside of the sensor attachment groove 28 but greater than the width of the opening 29, and therefore the position sensor 17 can be engaged with the opening 29 from the inside of the groove.

The platform-like portion 17*b* fits in the opening 29 of the sensor attachment groove 28 and prevents rotation.

At the front end of the position sensor 17, a threaded hole 17*c* is formed so as to extend through the position sensor 17 in a vertical direction. The sensor fixing screw 31 is screwed into the threaded hole 17*c*. In the middle of the position sensor 17, an indicator lamp 17*d* that lights upon position detection is provided.

The sensor fixing screw 31 has a constant diameter. An operating groove 31*a* for rotationally operating the sensor fixing screw 31 with a tool such as a driver is formed in the upper surface of the sensor fixing screw 31.

By screwing in the sensor fixing screw 31 and bringing the distal end thereof into contact with the groove bottom 28*b* of the sensor attachment groove 28, the position sensor 17 is lifted, engaged with the edge of the opening 29 of the sensor attachment groove 28 from the inside, and thereby fixed in the sensor attachment groove 28.

In the figures, reference sign 17*e* denotes a lead for taking out a position detection signal from the sensor.

At the lower ends of the left and right side surfaces of the sensor holding member 26, protruding edges 34 protruding in the width direction of the sensor holding member 26 are formed throughout the length of the sensor holding member 26. The upper ends of the left and right side surfaces, that is, the left and right shoulders of the sensor holding member 26 are chamfered to cut off the corners or formed into curved surfaces such as circular arcs. A plurality of engaging recesses 35 are formed in the left and right shoulders along the sensor attachment groove 28 at predetermined pitches in rows.

On the other hand, the attachment member 27 is a blockish member having a length about half the length of the sensor holding member 26. In the lower surface of the attachment member 27, an inverted U-shaped fitting groove 36 extending through the attachment member 27 from a first end 27*a* to a second end 27*b* in the direction of the cylinder axis L is formed. By fitting the sensor holding member 26 into the fitting groove 36, the attachment member 27 is placed on top of the sensor holding member 26 so as to straddle the sensor holding member 26.

The first end 27*a* of the attachment member 27 is the end on the side where the rear end of the sensor attachment groove 28, that is, the wall 30 is located. The second end 27*b* is the end on the side where the front end of the sensor attachment groove 28, that is, the sensor insertion opening 28*a* is located.

The fitting groove 36 has such a groove shape that a part of the sensor holding member 26 above the protruding edges 34 can fit in it. When the attachment member 27 is placed on top of the sensor holding member 26, an upper wall 36*a* that is the groove bottom of the fitting groove 36 is in contact with the upper surface of the sensor holding member 26.

Inside the fitting groove 36, on left and right groove walls corresponding to the engaging recesses 35 of the sensor holding member 26, a plurality of engaging protrusions 39 are formed at the same pitches as those of the engaging recesses 35 along the fitting groove 36 in rows. When the attachment member 27 is placed on top of the sensor holding member 26 and fixed with the attachment band 20 and the attachment screw 21, the engaging protrusions 39 fit in and engage with the engaging recesses 35.

Loosening the attachment screw 21 disengages the engaging protrusions 39 from the engaging recesses 35, and allows the sensor holding member 26 to be displaced relative to the attachment member 27.

The engaging protrusions 39 do not necessarily have to be formed on the left and right groove walls of the fitting groove 36 throughout the length of the fitting groove 36. It is only necessary to form at least a pair of engaging protrusions 39 in the middle, at one end, or the other end of the fitting groove 36 such that they face each other.

The left and right side surfaces 27*c* of the attachment member 27 are contact surfaces with which the clamping portions 20*b* and 20*c* of the attachment band 20 are in contact, and are formed into flat surfaces parallel to each other. In the side surfaces 27*c*, a screw insertion hole 40 continuous with the screw tightening holes 23*a* and 23*b* of the clamping portions 20*b* and 20*c* is formed so as to extend through the attachment member 27 in the width direction.

The attachment screw 21 is inserted through the first screw tightening hole 23*a* of one of the clamping portions 20*b* into the screw insertion hole 40 and is then screwed into the second screw tightening hole 23*b* of the other clamping portion 20*c*. By tightening the attachment screw 21 and thereby moving the two clamping portions 20*b* and 20*c* toward each other, the attachment member 27 is clamped and fixed between the two clamping portions 20*b* and 20*c*, and the sensor holding member 26 is pressed against and fixed to the outer surface of the cylinder tube 10 by the attachment member 27. The engaging protrusions 39 of the attachment member 27 engage with the engaging recesses 35 of the sensor holding member 26, and the sensor holding member 26 is prevented from being displaced.

At this time, the lower end of the attachment member 27, that is, the lower ends of both side walls of the fitting groove 36 are not in contact with the outer surface of the cylinder tube 10.

On the upper half of each of the left and right side surfaces 27*c* of the attachment member 27, two ribs 41 extending in the height direction of the attachment member 27 are formed parallel to each other. By placing the clamping portion 20*b* of the attachment band 20 between the two ribs 41, relative rotation between the clamping portion 20*b* and the sensor holder 18A about the attachment screw 21 is prevented when the attachment screw 21 is tightened. The ribs 41 may be formed throughout the height of the attachment member 27.

In the attachment member 27, a hollow portion 42 and a see-through window 43 each having a U shape in plan view are formed so as to extend from the first end 27*a* and the second end 27*b* of the attachment member 27 along the sensor attachment groove 28. The hollow portion 42 and the see-through window 43 each have such a depth that they extend from the upper surface of the attachment member 27 to the fitting groove 36, and have the same width as the width of the opening 29 of the sensor attachment groove 28. The hollow portion 42 is used for rotationally operating the sensor fixing screw 31 with a tool such as a driver. The see-through window 43 is used for viewing the indicator lamp 17*d* on the upper surface of the position sensor 17.

The position detecting device 2 is configured as above. When the position adjustment of the position sensor 17 is performed, the engaging protrusions 39 are disengaged from the engaging recesses 35 by loosening the attachment screw 21 and thereby loosening the connection between the attachment member 27 and the sensor holding member 26. In this state, the sensor holding member 26 is moved a necessary distance relative to the attachment member 27 in the direction of the cylinder axis L. After that, by tightening the attachment screw 21 again, the attachment portion is clamped and fixed between the clamping portions 20*b* and 20*c*, and the sensor holding member 26 is pressed against the outer surface of the cylinder tube 10 by the attachment member 27. At the same time, the engaging protrusions 39 engage with the engaging recesses 35, and the sensor holding member 26 is thereby fixed in a state where it is positioned in the position after the position adjustment.

Instead of displacing the sensor holding member 26, the position sensor 17 can be displaced separately relative to the sensor holding member 26 by loosening the sensor fixing screw 31. In this case, the attachment screw 21 need not be loosened.

Alternatively, the position adjustment can also be performed by displacing both the sensor holding member 26 and the position sensor 17.

Therefore, the degree of freedom in position adjustment is high, and even when the attachment position of the attachment band 20 is restricted, the position adjustment of the position sensor 17 can be reliably performed.

In addition, since it is not necessary to connect the attachment band 20 and the sensor holder 18A with an elongate hole, the problem in that the position sensor 17 is easily displaced along the elongate hole by vibration can be avoided.

FIG. 6 to FIG. 9 show a second embodiment of a sensor holder in the position detecting device of the present invention. The sensor holder 18B of the second embodiment differs from the sensor holder 18A of the first embodiment in that unlike the first embodiment, engaging recesses 35 and engaging protrusions 39 are not formed in the sensor holding member 26 and the attachment member 27, and instead, stoppers 50*a* and 50*b* that come into contact and engage with the first end 27*a* and the second end 27*b* of the attachment member 27 and prevent the sensor holding member 26 from disengaging from the attachment member 27 are formed at one end and the other end of the sensor holding member 26 in a direction along the sensor attachment groove 28.

That is, at the front end and rear end of the sensor holding member 26, the stoppers 50*a* and 50*b* having the same width as the width of the sensor holding member 26 and protruding upward are formed. When the sensor holding member 26 is displaced maximally, the stoppers 50*a* and 50*b* engage with the first end 27*a* and the second end 27*b* of the attachment member 27, and the sensor holding member 26 cannot be displaced further.

The configuration other than the above and the manner of attachment to the fluid pressure cylinder 1 of the second embodiment are substantially the same as those of the first embodiment. So, the same reference signs will be used to designate the same components as those in the first embodiment, and the description will be omitted.

As a modification of the sensor holder 18B of the second embodiment, the stoppers 50*a* and 50*b* may be removed. This modification is specifically such that the engaging recesses 35 of the sensor holding member 26 and the engaging protrusions 39 of the attachment member 27 are removed from the sensor holder 18A of the first embodiment.

FIG. 10 to FIG. 13 show a third embodiment of a sensor holder in the position detecting device of the present invention. This sensor holder 18C differs from the sensor holder 18A of the first embodiment mainly in that it employs a sensor fixing screw 31A having a flange-like engaging portion 31*b* on its head.

The sensor fixing screw 31A is screwed into the threaded hole 17*c* of the position sensor 17 such that its head protrudes through the opening 29 of the sensor attachment groove 28 of the sensor holding member 26 to the outside of the sensor attachment groove 28. On the head, the engaging portion 31*b* that can engage with the flat edge outer surface 29*a* of the opening 29 of the sensor attachment groove 28 from the outside of the sensor attachment groove 28 is formed. Therefore, the diameter of the engaging portion 31*b* is greater than the width of the opening 29.

In the attachment member 27, above the fitting groove 36, a through-hole 52 wider than the fitting groove 36 is formed along the fitting groove 36 so as to extend through the attachment member 27. The hole width in the left-right direction of the through-hole 52 is greater than the width of the opening 29 of the sensor attachment groove 28 and the diameter of the engaging portion 31*b* of the sensor fixing screw 31A. The vertical width (top-bottom width) of the through-hole 52 is greater than the thickness of the engaging portion 31*b* of the sensor fixing screw 31A. The width of the hollow portion 42 is less than the diameter of the engaging portion 31*b* of the sensor fixing screw 31A. Therefore, the engaging portion 31*b* can fit in the through-hole 52, and the engaging portion 31*b* can come into contact with the upper wall surface 52*a* of the through-hole 52 in the position of the hollow portion 42.

The engaging portion 31*b* preferably has a circular shape in plan view. Of the upper and lower surfaces of the engaging portion 31*b*, the lower surface part that comes into contact with the edge outer surface 29*a* and the upper surface part that comes into contact with the upper wall surface 52*a* of the through-hole 52 are preferably formed into flat surfaces. In the upper surface of the engaging portion 31*b*, an operating groove 31*a* with which the tip of a tool such as a driver is engaged to rotationally operate is formed.

By rotating the sensor fixing screw 31A clockwise or counterclockwise, the engaging portion 31*b* is selectively brought into contact with the edge outer surface 29*a* of the opening 29 of the sensor attachment groove 28 and the upper wall surface 52*a* of the through-hole 52, and the position sensor 17 can thereby be fixed in the sensor attachment groove 28.

Figure 12:
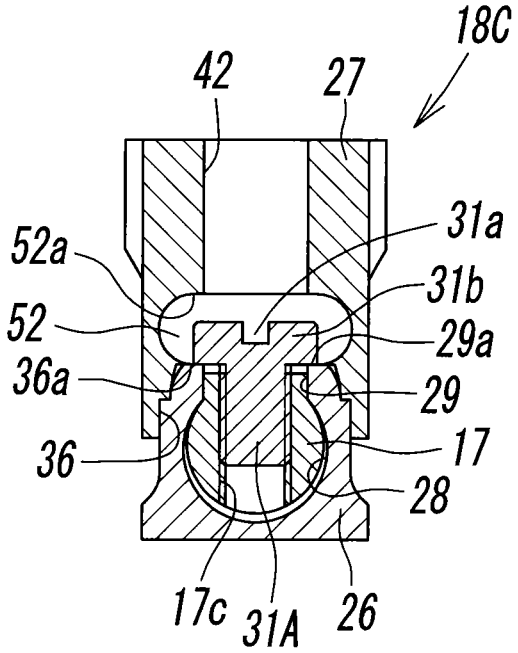
FIG. 12 is a sectional view showing a fixation embodiment of the position sensor with a sensor fixing screw.

That is, as shown in FIG. 12, when the sensor fixing screw 31A is rotated clockwise, the engaging portion 31*b* engages with the edge outer surface 29*a* of the opening 29 from the outside of the sensor attachment groove 28, and therefore the position sensor 17 is pulled up by the sensor fixing screw 31A, comes into contact and engages with the edge inner surface of the opening 29 of the sensor attachment groove 28 from the inside, and is fixed in the sensor attachment groove 28. At this time, the engaging portion 31*b* engages with the flat edge outer surfaces 29*a* on both sides of the opening 29 so as to straddle them, and maintains a horizontal position, and therefore the position sensor 17 is also fixed horizontally. This method of fixation can be used both when the sensor fixing screw 31A fits in the through-hole 52 in the position of the hollow portion 42 and when the sensor fixing screw 31A is completely out of the through-hole 52.

Figure 13:
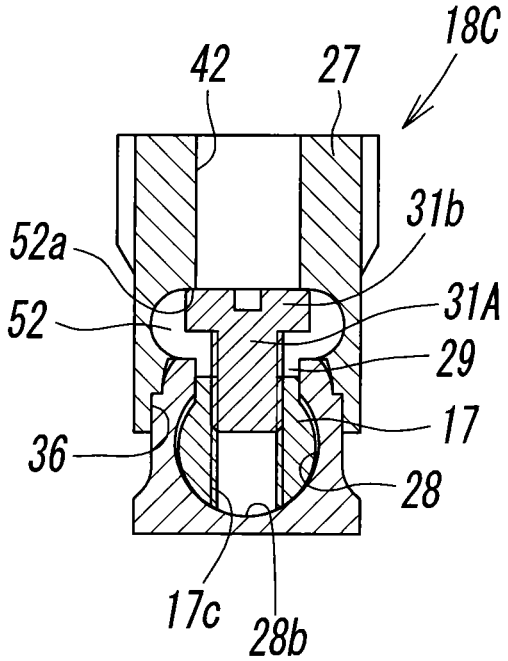
FIG. 13 is a sectional view showing another fixation embodiment of the position sensor with a sensor fixing screw.

When the sensor fixing screw 31A fits in the through-hole 52 in the position of the hollow portion 42, as shown in FIG. 13, rotating the sensor fixing screw 31A counterclockwise through the hollow portion 42 with a tool lifts the sensor fixing screw 31A and brings the engaging portion 31*b* into contact with the horizontal upper wall surface 52*a* of the through-hole 52. By further rotating the sensor fixing screw 31A in this state, the position sensor 17 is pressed against and fixed to the groove bottom 28*b* of the sensor attachment groove 28. Also in this case, the engaging portion 31*b* comes into contact with the horizontal upper wall surface 52*a* and maintains a horizontal position, and therefore the position sensor 17 is also fixed horizontally.

As described above, by rotating the sensor fixing screw 31A clockwise or counterclockwise and thereby selectively bringing the engaging portion 31*b* into contact with the edge outer surface 29*a* of the opening 29 of the sensor attachment groove 28 and the upper wall surface 52*a* of the through-hole 52, the position sensor 17 can be fixed in a state where the position sensor 17 is out of contact with the groove bottom 28*b* of the sensor attachment groove 28 or a state where the position sensor 17 is pressed against the groove bottom 28*b*. The method of fixation of the position sensor 17 can be selected according to the installation condition of the position detecting device 2.

The tip of the sensor fixing screw 31A does not come into contact with the groove bottom 28*b* of the sensor attachment groove 28 both when the sensor fixing screw 31A is rotated clockwise to fix the position sensor 17 and when the sensor fixing screw 31A is rotated counterclockwise to fix the position sensor 17, and therefore the groove bottom 28*b* of the sensor attachment groove 28 is not damaged by the sensor fixing screw 31A. Therefore, the thickness of the groove bottom 28*b* can be reduced to improve the sensitivity of the position sensor 17.

The configuration other than the above and the manner of attachment to the fluid pressure cylinder of the third embodiment are substantially the same as those of the first embodiment. So, the same reference signs will be used to designate the same components as those in the first embodiment, and the description will be omitted.

The configuration concerning the sensor fixing screw 31A in the third embodiment can also be applied to the sensor holder 18B of the second embodiment, in which the sensor holding member 26 and the attachment member 27 do not have engaging recesses 35 and engaging protrusions 39, and the sensor holder 18B of the second embodiment from which the stoppers 50*a* and 50*b* are removed.

In the embodiments described above, when the sensor holders 18A, 18B, and 18C are formed of a synthetic resin, they can be formed of an opaque synthetic resin or a transparent synthetic resin. When they are formed of an opaque synthetic resin, it is desirable to form a see-through window 43 for viewing the indicator lamp 17*d* of the position sensor 17 as in each embodiment. When they are formed of a transparent synthetic resin, such a see-through window 43 does not necessarily have to be provided.

REFERENCE SIGNS LIST

1 fluid pressure cylinder
2 position detecting device
10 cylinder tube
13 piston
17 position sensor
17*d* indicator lamp
18A, 18B, 18C sensor holder
20 attachment band
20*a* band main body
20*b*, 20*c* clamping portion
21 attachment screw
26 sensor holding member
27 attachment member
27*a* first end
27*b* second end
28 sensor attachment groove
28*a* sensor insertion opening
28*b* groove bottom
29 opening
29*a* edge outer surface
31, 31A sensor fixing screw
31*b* engaging portion
35 engaging recess
36 fitting groove
36*b* upper wall
39 engaging protrusion
41 rib
42 hollow portion
43 see-through window
50*a*, 50*b* stopper
52 through-hole
L axis

The invention claimed is:

1. A position detecting device for a fluid pressure cylinder, comprising: a position sensor that detects the position of a piston of a fluid pressure cylinder; a sensor holder that position-adjustably holds the position sensor; and an attachment band that attaches the sensor holder to the outer periphery of the fluid pressure cylinder, wherein the attachment band has a band main body surrounding the outer periphery of the fluid pressure cylinder and a pair of clamping portions formed at respective opposite ends of the band main body so as to face each other, wherein the sensor holder includes a sensor holding member having a sensor attachment groove in which the position sensor fits and an attachment member clamped between the pair of clamping portions of the attachment band, and the sensor holding member and the attachment member are formed separately, and wherein the sensor attachment groove is oriented in the direction of the axis of the fluid pressure cylinder, with the sensor holding member in contact with the outer surface of the fluid pressure cylinder, wherein the sensor holding member is fitted in a fitting groove in the lower surface of the attachment member, so as to be straddled by the attachment member, the attachment member and the sensor holding member are fixed to each other by tightening an attachment screw and fixing the attachment member between the clamping portions, and loosening the attachment screw allows the sensor holding member to be displaced relative to the attachment member in the direction of the axis of the fluid pressure cylinder.

2. The position detecting device according to claim 1, wherein the position sensor has an indicator lamp that lights during operation and a sensor fixing screw that fixes the position sensor in the sensor attachment groove, the attachment member has, at one end and the other end in a direction along the sensor attachment groove, a hollow portion and a see-through window each having such a depth that they extend from the upper surface of the attachment member to the fitting groove, the hollow portion is used for rotationally operating the sensor fixing screw with a tool, and the see-through window is used for viewing the indicator lamp.

3. The position detecting device according to claim 2, wherein the hollow portion and the see-through window are recesses formed so as to extend from one end and the other end of the attachment member toward the center of the attachment member.

4. The position detecting device according to claim 2, wherein on each of the left and right side surfaces of the attachment member, two ribs extending in the height direction of the attachment member are formed parallel to each other, and by placing the clamping portion of the attachment band between the two ribs, relative rotation between the clamping portion and the sensor holder is prevented.

5. The position detecting device according to claim 2, wherein when the sensor holder is fixed to the outer periphery of the fluid pressure cylinder with the attachment band, a upper wall of the fitting groove is in contact with a upper surface of the sensor holding member, and lower ends of both side walls of the fitting groove are out of contact with the outer surface of the fluid pressure cylinder.

6. The position detecting device according to claim 2, wherein a plurality of engaging recesses are formed along the sensor attachment groove in rows, and engaging protrusions are formed in the attachment member, the engaging protrusions are engaged with the engaging recesses when the attachment screw is tightened, and the engaging protrusions are disengaged from the engaging recesses when the attachment screw is loosened.

7. The position detecting device according to claim 6, wherein the engaging recesses are respectively formed on both left and right sides of the sensor attachment groove, and the engaging protrusions are formed on each of left and right groove walls of the fitting groove in the attachment member.

8. The position detecting device according to claim 2, wherein stoppers that engage with the ends of the attachment member and prevent the sensor holding member from disengaging from the attachment member are formed at one end and the other end of the sensor holding member in a direction along the sensor attachment groove.

9. The position detecting device according to claim 2, wherein a sensor fixing screw that fixes the position sensor in the sensor attachment groove has a flange-like engaging portion on its head, the engaging portion can be selectively engaged with an edge outer surface of an opening of the sensor attachment groove and the upper wall surface of a through-hole of the attachment member by rotating the sensor fixing screw clockwise and counterclockwise, the position sensor is engaged with and fixed to an edge inner surface of the opening of the sensor attachment groove when the engaging portion is engaged with the edge outer surface, and the position sensor is pressed against and fixed to the groove bottom of the sensor attachment groove when the engaging portion is engaged with the upper wall surface of the through-hole.

10. The position detecting device according to claim 1, wherein on each of the left and right side surfaces of the attachment member, two ribs extending in the height direction of the attachment member are formed parallel to each other, and by placing the clamping portion of the attachment band between the two ribs, relative rotation between the clamping portion and the sensor holder is prevented.

11. The position detecting device according to claim 1, wherein when the sensor holder is fixed to the outer periphery of the fluid pressure cylinder with the attachment band, an upper wall of the fitting groove is in contact with the upper surface of the sensor holding member, and lower ends of both side walls of the fitting groove are out of contact with the outer surface of the fluid pressure cylinder.

12. The position detecting device according to claim 1, wherein one end of the sensor attachment groove includes an insertion hole in which the position sensor is inserted, and the other end is closed by a wall.

13. The position detecting device according to claim 1, wherein a plurality of engaging recesses are formed along the sensor attachment groove in rows, and engaging protrusions are formed in the attachment member, the engaging protrusions are engaged with the engaging recesses when the attachment screw is tightened, and the engaging protrusions are disengaged from the engaging recesses when the attachment screw is loosened.

14. The position detecting device according to claim 13, wherein the engaging recesses are respectively formed on both left and right sides of the sensor attachment groove, and the engaging protrusions are formed on each of left and right groove walls of the fitting groove in the attachment member.

15. The position detecting device according to claim 1, wherein stoppers that engage with the ends of the attachment member and prevent the sensor holding member from disengaging from the attachment member are formed at one end and the other end of the sensor holding member in a direction along the sensor attachment groove.

16. The position detecting device according to claim 1, wherein a sensor fixing screw that fixes the position sensor in the sensor attachment groove has a flange-like engaging portion on its head, the engaging portion can be selectively engaged with an edge outer surface of an opening of the sensor attachment groove and the upper wall surface of a through-hole of the attachment member by rotating the sensor fixing screw clockwise and counterclockwise, the position sensor is engaged with and fixed to an edge inner surface of the opening of the sensor attachment groove when the engaging portion is engaged with the edge outer surface, and the position sensor is pressed against and fixed to the groove bottom of the sensor attachment groove when the engaging portion is engaged with the upper wall surface of the through-hole.

* * * * *